US005955249A

United States Patent [19]

Adin et al.

[11] Patent Number: 5,955,249

[45] Date of Patent: Sep. 21, 1999

[54] RADIOGRAPHIC ELEMENTS EXHIBITING INCREASED SPEED AND COVERING POWER

[75] Inventors: Anthony Adin; Jerome J. Looker, both of Rochester, N.Y.

[73] Assignee: Eastman Kodak Company, Rochester, N.Y.

[21] Appl. No.: 09/037,556

[22] Filed: Mar. 9, 1998

[51] Int. Cl.[6] ..... G03C 1/10; G03C 5/16

[52] U.S. Cl. ..... 430/502; 430/966; 430/603; 430/611; 430/965; 430/402

[58] Field of Search ..... 430/966, 611, 430/603, 965, 402, 502

[56] References Cited

U.S. PATENT DOCUMENTS

| | | |
|---|---|---|
| 3,150,977 | 9/1964 | Hart et al. . |
| 3,895,948 | 7/1975 | Shiba et al. . |
| 4,983,494 | 1/1991 | Kitaguchi et al. . |

FOREIGN PATENT DOCUMENTS

| | | |
|---|---|---|
| 1004302 | 5/1963 | United Kingdom . |
| 1049052 | 8/1965 | United Kingdom . |

OTHER PUBLICATIONS

Research Disclosure, vol. 184, Aug. 1979, Item 18431, II.

*Primary Examiner*—Richard L. Schilling
*Assistant Examiner*—Amanda C. Walke
*Attorney, Agent, or Firm*—Carl O. Thomas

[57] ABSTRACT

A radiographic element is disclosed containing in a high bromide tabular grain emulsion layer a 5-mercaptotetrazole to increase covering power. The 5-mercaptotetrazole is additionally capable of increasing imaging speed and producing colder image tones when provided with a phenyl substituent in the 1 ring position, which phenyl substituent is in turn substituted in its para position with a substituent satisfying the formula $R(OCH_2CH_2)_nO$— wherein n is an integer of from zero to 5; when n is 1 to 5, R is hydrogen, methyl or ethyl; and, when n is zero, R is methyl.

10 Claims, No Drawings

RADIOGRAPHIC ELEMENTS EXHIBITING INCREASED SPEED AND COVERING POWER

FIELD OF THE INVENTION

The invention relates to a radiographic element. More specifically, the invention relates to a radiographic element containing a radiation-sensitive silver halide emulsion layer.

DEFINITION OF TERMS

In referring to grains and emulsions containing two or more halides, the halides are named in order of ascending concentrations.

The term "high bromide" in referring to grains and emulsions indicates that bromide is present in a concentration of greater than 50 mole percent, based on silver.

The term "equivalent circular diameter" or "ECD" is employed to indicate the diameter of a circle having the same projected area as a silver halide grain.

The term "aspect ratio" designates the ratio of grain ECD to grain thickness (t).

The term "tabular grain" indicates a grain having two parallel crystal faces which are clearly larger than any remaining crystal faces and an aspect ratio of at least 2.

The term "tabular grain emulsion" refers to an emulsion in which tabular grains account for greater than 50 percent of total grain projected area.

Covering power is defined as 100 times the ratio of maximum density to developed silver expressed in milligrams per square decimeter.

The terms "front" and "back" in referring to radiographic imaging are used to designate locations nearer to and farther from, respectively, the source of X-radiation than the support of the radiographic element The term "dual-coated" is used to indicate a radiographic element having emulsion layers coated on both the front and back sides of its support.

The terms "colder" and "warmer" in referring to image tone are used to mean CIELAB b* values measured at a density of 0.6 (single-sided) or 1.0 (dual-coated) above minimum density that are more negative or positive, respectively. The b* measurement technique is described by Billmeyer and Saltzman, *Principles of Color Technology,* 2nd. Ed., Wiley, N.Y., 1981, at Chapter 3. The b* values describe the yellowness vs. blueness of an image with more positive values indicating a tendency toward greater yellowness.

*Research Disclosure* is published by Kenneth Mason Publications, Ltd., Dudley House, 12 North St., Emsworth, Hampshire P010 7DQ, England.

PRIOR ART

Although high bromide tabular grain emulsions are well recognized to offer a variety of performance advantages, these emulsions often exhibit warmer image tones (higher b* values) than are optimum for radiographic imaging. Radiologists prefer blue-black images as compared to brown-black images, since the former are considered more aesthetically appealing and less visually tiring to inspection.

Adin et al U.S. Ser. No. 08/864,088, filed May 28, 1997, commonly assigned and now allowed, discloses that a combination of category (a) and category (b) addenda in a high bromide tabular grain emulsion of a radiographic element increases covering power and produces colder (lower b*) image tones. In one of several different forms, category (a) addenda are 5-mercaptotetrazoles. The following 5-mercaptotetrazole compounds are disclosed: 1-phenyl-5-mercaptotetrazole, 1-(α-naphthyl)-5-mercaptotetrazole, 1-cyclohexyl-5-mercaptotetrazole, 1-methyl-5-mercaptotetrazole, 1-ethyl-5-mercaptotetrazole, 1-allyl-5-mercaptotetrazole, 1-isopropyl-5-mercaptotetrazole, 1-benzoyl-5-mercaptotetrazole, 1-p-chlorophenyl-5-mercaptotetrazole, 1-p-methylphenyl-5-mercaptotetrazole, 1-p-methoxycarbonylphenyl-5-mercaptotetrazole, and 1-p-diethylaminophenyl-5-mercaptotetrazole. Comparative data show little or no reduction in b* values (quantitatively indicating colder image tones) when a category (a) covering power enhancer is employed in the absence of a category (b) covering power enhancer.

5-Mercaptotetrazoles and tautomers have been employed extensively and for a wide variety of photographic uses. The following citations show diversity in structural forms and utility: Shiba et al U.S. Pat. No. 3,895,948; Kitaguchi et al U.S. Pat. No. 4,983,494; and U.K. Patents 1,004,302 and 1,049,052. "Radiographic films/materials", *Research Disclosure,* Vol. 184, August 1979, Item 18431, II. Emulsion Stabilizers, Antifoggants and Antikinking agents discloses 5-mercaptotetrazoles (named as 1-tetrazoline-5-thiones).

Hart et al U.S. Pat. No. 3,150,977 teaches that polyalkylene oxides having a molecular weight of at least 400, preferably 1500 to 2000 act as development accelerators, but, when added to a photographic emulsion, reduce stability and produce brown and reddish-brown (i.e., high b*) images. Hart et al suggests attaching polyalkylene oxide pendant groups to vinyl backbone polymers to avoid undesirable image tones and increase storage stability.

SUMMARY OF THE INVENTION

In one aspect, this invention is directed to a radiographic element comprised of a support and, coated on the support, an emulsion comprised of (1) a hydrophilic colloid and (2) radiation-sensitive silver halide grains containing greater than 50 mole percent bromide and less than 3 mole percent iodide, based on silver, greater than 50 percent of the total projected area of the silver halide grains being accounted for by tabular grains having a thickness of less than 0.3 μm, and, (3) in an amount sufficient to increase covering power, a 5-mercaptotetrazole, wherein the 5-mercaptotetrazole is a 1-(4-M-phenyl)-5-mercaptotetrazole in which M satisfies the formula:

$$R(OCH_2CH_2)_nO—$$

wherein n is an integer of from zero to 5;

when n is 1 to 5, R is hydrogen, methyl or ethyl; and, when n is zero, R is methyl.

As demonstrated in the Examples below, both covering power and imaging speed are increased without creating warmer image tones. In many instances colder image tones (lower b* values) are concurrently realized. These advantages are realized, provided, (a) the M substituent is located in the para (4 bonding position) of the phenyl ring and (b) R and n are selected as indicated.

DESCRIPTION OF PREFERRED EMBODIMENTS

The practice of the invention in one simple form can be appreciated by reference to the following assembly:

| Screen Support |
|---|
| Luminescent Layer |

| Emulsion Layer Unit |
|---|
| Support |

Assembly A

Assembly A consists of a fluorescent intensifying screen shown formed of a Screen Support and a Luminescent Layer and a radiographic element formed by the Support and Emulsion Layer Unit.

The fluorescent intensifying screen can take any convenient conventional form. Its function is to absorb X-radiation that has been differentially modulated during transmission through a subject to create an image pattern and to emit light to the radiographic element in an image pattern corresponding to the image pattern of X-radiation received. The Screen Support is transparent to X-radiation. It can be transparent to emitted light, capable of absorbing emitted light, or reflective to emitted light. The sharpest image definitions are obtained when the Screen Support is light absorptive, and the highest imaging speeds are realized when the Screen Support is light reflective (typically white). The Luminescent Layer contains phosphor particles, capable of absorbing X-radiation and promptly emitting light, dispersed in a binder. The binder is transparent, but can contain reflective pigment particles to increase useful light output or absorptive pigment articles to intercept and absorb disproportionately laterally scattered light, thereby increasing image sharpness. Conventional intensifying screen constructions and materials are disclosed in *Research Disclosure,* Item 18431, cited above, IX. X-Ray Screens/Phosphors.

The radiographic element in its simplest form requires only the two elements shown for its construction. The Support can be either transparent (typically colorless or blue tinted) or reflective (typically white). A white support increases imaging speed, since light received from the fluorescent screen passes through the Emulsion Layer Unit twice and thereby has two chances of being absorbed. However, image sharpness is higher when the Support is transparent. Use radiographic element supports are disclosed in *Research Disclosure,* Item 18431, cited above, XII. Film Supports, and in *Research Disclosure,* Vol. 389, September 1996, Item 38957, XV. Supports. The supports include subbing layers to promote adhesion to hydrophilic colloid layers.

The Emulsion Layer Unit as contemplated by the invention contains a high bromide tabular grain emulsion layer. The emulsion layer contains as a minimum (a) a hydrophilic colloid vehicle, (b) a 1-(4-M-phenyl)-5-mercaptotetrazole, and (c) radiation-sensitive high bromide silver halide grains including sufficient tabular grains to form a tabular grain emulsion.

The 1-(4-M-phenyl)-5-mercaptotetrazole has been found, surprisingly, to be capable of increasing imaging speed, increasing covering power, and producing colder image tones. The most advantageous combination of these properties has been found to be dependent on (a) locating the "M" substituent in para (4 ring) position on the phenyl ring and choosing the "M" substituent to satisfy the formula:

$$R(OCH_2CH_2)_nO— \quad (I)$$

wherein n is an integer of from zero to 5;

when n is 1 to 5, R is hydrogen, methyl or ethyl; and, when n is zero, R is methyl.

The following are specific compounds satisfying formula (I), where Me=methyl, Et=ethyl, Ph=phenyl:

PMT-1 1-(4-MeOPh)-5-mercaptotetrazole;
PMT-2 1-(4-$HOCH_2CH_2OPh$)-5-mercaptotetrazole;
PMT-3 1-(4-$MeOCH_2CH_2OPh$)-5-mercaptotetrazole;
PMT-4 1-(4-$EtOCH_2CH_2OPh$)-5-mercaptotetrazole;
PMT-5 1-[4-$HO(CH_2CH_2O)_2Ph$]-5-mercaptotetrazole;
PMT-6 1-[4-$MeO(CH_2CH_2O)_2Ph$]-5-mercaptotetrazole;
PMT-7 1-[4-$EtO(CH_2CH_2O)_2Ph$]-5-mercaptotetrazole;
PMT-8 1-[4-$HO(CH_2CH_2O)_3Ph$]-5-mercaptotetrazole;
PMT-9 1-[4-$MeO(CH_2CH_2O)_3Ph$]-5-mercaptotetrazole;
PMT-10 1-[4-$EtO(CH_2CH_2O)_3Ph$]-5-mercaptotetrazole;
PMT-11 1-[4-$HO(CH_2CH_2O)_4Ph$]-5-mercaptotetrazole;
PMT-12 1-[4-$MeO(CH_2CH_2O)_4Ph$]-5-mercaptotetrazole;
PMT-13 1-[4-$EtO(CH_2CH_2O)_4Ph$]-5-mercaptotetrazole;
PMT-14 1-[4-$HO(CH_2CH_2O)_5Ph$]-5-mercaptotetrazole;
PMT-15 1-[4-$MeO(CH_2CH_2O)_5Ph$]-5-mercaptotetrazole; and
PMT-16 1-[4-$EtO(CH_2CH_2O)_5Ph$]-5-mercaptotetrazole.

The formula (I) 5-mercaptotetrazoles are capable of providing improvements in speed and image tone in any covering power enhancing concentration. It is generally preferred that the formula (I) 5-mercaptotetrazoles be incorporated in a concentration of at least 20 mg/Ag mole. Generally the full advantages of the formula (I) 5-mercaptotetrazoles are realized prior to reaching a concentration of 1 g/Ag mole. A specifically preferred concentration range for the formula (I) 5-mercaptotetrazole is from 50 to 500 mg/Ag mole.

The radiation-sensitive silver halide grains in the emulsion layer contain greater than 50 mole percent bromide, based on silver, and less than 3 mole iodide, based on silver. Any halide other than bromide and iodide can be chloride and can account for up to (but not including) 50 mole percent of total halide, based on silver. Preferably chloride, if present, is limited to less than 10 mole percent, based on silver. Preferred silver halide grain compositions are silver bromide and silver iodobromide, with silver chlorobromide, silver iodochlorobromide and silver chloroiodobromide also being contemplated.

Tabular grains account for at least 50 percent of total grain projected area. Preferably tabular grains account for at least 70 percent and optimally at least 90 percent of total grain projected area. In highly uniform grain emulsions tabular grains have been observed to account for substantially all (>97%) of total grain projected area.

The tabular grains have a mean ECD ranging up to 10 $\mu$m. In practice, mean ECD's seldom exceed 5 $\mu$m. The emulsions in the radiographic elements of this invention in all instances exhibit a mean ECD of greater than 0.3 $\mu$m.

The mean thickness (t) of the tabular grains is less than 0.3 $\mu$m. Preferred tabular grain emulsions contain thin tabular grains having mean thicknesses of less than 0.2 $\mu$m. By reason of the colder image tones exhibited by the tabular grain emulsions of this invention, mean tabular grain thicknesses of less than 0.1 $\mu$m are specifically contemplated.

The silver halide grains and the formula (I) 5-mercaptotetrazole are suspended in a hydrophilic colloid vehicle within the emulsion layer. The vehicle contains hydrophilic colloids that act as a peptizer for the grains and as a binder for the layer. A preferred class of hydrophilic colloid vehicles capable of performing both functions are gelatino-vehicles, commonly referred to as "gelatin", but including variations in form, such as alkali-treated gelatin (cattle bone or hide gelatin), acid-treated gelatin (pigskin gelatin) and gelatin derivatives—e.g., acid-treated gelatin, such as acetylated gelatin or phthalated gelatin. A more extensive discussion of hydrophilic vehicles and related addenda, such as hardeners and vehicle extenders, useful for forming the emulsion layer and other processing solution permeable layers of the radiographic elements of the invention is contained in *Research Disclosure*, Item 38957, cited above, II. Vehicles, vehicle extenders, vehicle-like addenda and vehicle related addenda.

In addition to the basic essential components named above the emulsion layers also commonly contain chemical and spectral sensitizers for the radiation-sensitive silver halide grains, antifoggants and stabilizers, and other addenda to enhance performance and physical integrity. Such addenda are disclosed in *Research Disclosure,* Item 38957, cited above, with attention being directed particularly to IV. Chemical sensitization, V. Spectral sensitization and desensitization, and VII. Antifoggants and stabilizers.

High bromide silver halide tabular grain emulsion layers, including radiation-sensitive grains, vehicles, and common incorporated addenda are disclosed by the following patents, the disclosures of which are here incorporated by reference:

| | |
|---|---|
| Dickerson | U.S. Pat. No. 4,414,310; |
| Abbott et al | U.S. Pat. No. 4,425,425; |
| Abbott et al | U.S. Pat. No. 4,425,426; |
| Kofron et al | U.S. Pat. No. 4,439,520; |
| Wilgus et al | U.S. Pat. No. 4,434,226; |
| Maskasky | U.S. Pat. No. 4,435,501; |
| Maskasky | U.S. Pat. No. 4,713,320; |
| Dickerson et al | U.S. Pat. No. 4,803,150; |
| Dickerson et al | U.S. Pat. No. 4,900,355; |
| Dickerson et al | U.S. Pat. No. 4,994,355; |
| Dickerson et al | U.S. Pat. No. 4,997,750; |
| Bunch et al | U.S. Pat. No. 5,021,327; |
| Tsaur et al | U.S. Pat. No. 5,147,771; |
| Tsaur et al | U.S. Pat. No. 5,147,772; |
| Tsaur et al | U.S. Pat. No. 5,147,773; |
| Tsaur et al | U.S. Pat. No. 5,171,659; |
| Dickerson et al | U.S. Pat. No. 5,252,442; |
| Dickerson | U.S. Pat. No. 5,391,469; |
| Dickerson et al | U.S. Pat. No. 5,399,470; |
| Maskasky | U.S. Pat. No. 5,411,853; |
| Maskasky | U.S. Pat. No. 5,418,125; |
| Daubendiek et al | U.S. Pat. No. 5,494,789; |
| Olm et al | U.S. Pat. No. 5,503,970; |
| Wen et al | U.S. Pat. No. 5,536,632; |
| King et al | U.S. Pat. No. 5,518,872; |
| Fenton et al | U.S. Pat. No. 5,567,580; |
| Daubendiek et al | U.S. Pat. No. 5,573,902; |
| Dickerson | U.S. Pat. No. 5,576,156; |
| Daubendiek et al | U.S. Pat. No. 5,576,168; |
| Olm et al | U.S. Pat. No. 5,576,171; |
| Deaton et al | U.S. Pat. No. 5,582,965. |

The AgIBr tabular grain emulsions having iodide levels above 3 mole percent, based on silver, can be readily modified to reduce iodide to useful levels merely by reducing or eliminating incorporated iodide. The patents to Abbott et al, Fenton et al, Dickerson and Dickerson et al disclose radiographic elements of the type useful in the practice of the invention and therefore cited and incorporated by reference to conventional radiographic element features in addition to the emulsion layers.

While Assembly A shown above represents the simplest possible radiographic element construction, in practice additional layers are usually included. For example, the Emulsion Layer Unit of Assembly A is commonly divided into fast and slow superimposed emulsion layers with the fast layer being located to receive exposing radiation from the intensifying screen before the slow emulsion layer.

In a single-sided format intended to be used with a single intensifying screen, a common radiographic element construction can take the following form:

| |
|---|
| Protective Layer Unit |
| Emulsion Layer Unit |
| Transparent Film Support |
| Pelloid Layer |

Radiographic Element SS-1

The Transparent Film Support and Emulsion Layer Unit can be constructed as described above. The Pelloid Layer contains a hydrophilic colloid vehicle and serves the purpose of counteracting forces applied by the coating on the opposite side of the support that would otherwise cause the support to curl. The Pelloid Layer is commonly referred to as an anticurl layer. In addition to protecting the Transparent Film Support against curl, the Pelloid Layer is commonly chosen as a location for placing processing solution decolorizable dye used for antihalation protection of the Emulsion Layer Unit. Common antihalation dyes and their decolorization in processing are disclosed in *Research Disclosure,* Item 38957, VIII. Absorbing and scattering materials, B. Absorbing materials and C. Discharge.

The Protective Layer Unit is typically provided for physical protection of the underlying Emulsion Layer Unit. In addition to a hydrophilic colloid vehicle discussed above the protective layer units can contain various addenda to modify the physical properties of the overcoats. Such addenda are illustrated by *Research Disclosure,* Item 38957, IX. Coating physical property modifying addenda, A. Coating aids, B. Plasticizers and lubricants, C. Antistats, and D. Matting agents. It is common practice to divide Protective Layer Unit into a surface overcoat and an interlayer. The interlayers are typically thin hydrophilic colloid layers that provide a separation between the emulsion and the surface overcoat addenda. It is quite common to locate surface overcoat addenda, particularly anti-matte particles, in the interlayers.

More than half of radiographic imaging is undertaken with radiographic elements in a dual-coated format intended to be imagewise exposed with a pair of front and back intensifying screens. In its simplest possible construction an assembly of this type can take the following form:

| |
|---|
| Front Screen Support |
| Front Luminescent Layer |

| |
|---|
| Front Emulsion Layer Unit |
| Transparent Film Support |
| Back Emulsion Layer Unit |

| |
|---|
| Back Luminescent Layer |
| Back Screen Support |

Assembly B

The front and back screens formed by a luminescent layer and support can be identical, but the phosphor coating coverage in the Back Luminescent Layer is usually somewhat higher to compensate for X-radiation absorption by the Front Luminescent Layer. The Front and Back Emulsion Layer Units can be identical. Since two emulsion layer units in a dual-coated format replace the single emulsion layer unit in a single-sided format, the silver coating coverage per emulsion layer unit is decreased to maintain a similar overall silver coating coverage.

A preferred dual-coated format radiographic element construction is illustrated by the following:

| |
|---|
| Protective Layer Unit |
| Emulsion Layer Unit |
| Crossover Reduction Layer |
| Transparent Film Support |
| Crossover Reduction Layer |
| Emulsion Layer Unit |
| Protective Layer Unit |

Radiographic Element DC-1

The Protective Layer Units and Transparent Film Support can be identical to those employed in Radiographic Element SS-1, described above. The Emulsion Layer Units are similar to those of the Emulsion Layer Unit of Radiographic Element SS-1, except that the coating coverages in the Emulsion Layer Units are reduced to adjust for two Emulsion Layer Units being used instead of only one. Overall the silver coating coverages can remain unchanged.

The new features in Radiographic Element DC-1 are the Crossover Reduction Layers. These layers contain a crossover reducing dye dispersed in a hydrophilic colloid vehicle. The crossover reducing dye prevents or reduces light emitted from the Front Luminescent Layer reaching the Back Emulsion Layer Unit and light emitted from the Back Luminescent Layer reaching the Front Emulsion Layer Unit. This increases image sharpness. *Research Disclosure,* Item 18431, cited above, V. Cross-Over Exposure Control, discloses the general function of crossover reducing layers in radiographic elements and materials for their construction. Abbott et al, cited above, and Dickerson et al U.S. Pat. Nos. 4,803,150 and 4,900,355 are incorporated by reference to show preferred processing solution decolorizable dye particles employed for crossover reduction. When crossover levels are reduced below 10 percent, it is advantageous to employ asymmetrical film constructions (those in which the front and back emulsion layer units produce different image characteristics), as illustrated by Dickerson et al U.S. Pat. Nos. 4,994,335, 4,997,750 and 5,390,470 and Bunch et al U.S. Pat. No. 5,021,327, the disclosures of which are incorporated by reference.

EXAMPLES

The following specific embodiments further illustrate the invention.

Grain coating coverages are based on the weight of silver. Speed measured on the characteristic curve at $D_{min}$+0.2 is referred to as +0.2 Spd. Relative speeds are assigned on the basis of exposure differences rather than log exposure differences. In designating coatings, the suffix (c) indicates comparative color power enhancing addenda or comparative coatings while the suffix (ex) indicates 5-mercaptotetrazoles and coatings satisfying invention requirements.

The following 5-mercaptotetrazoles failing to satisfy formula (I) were incorporated in coatings to provide performance comparisons with the inventive coatings:

PMT-17(c) 1-Phenyl-5-mercaptotetrazole

PMT-18(c) 1-(3-Acetamidophenyl)-5-mercaptotetrazole

PMT-19(c) 1-[3-MeO($CH_2CH_2O$)$_3$Ph]-5-mercaptotetrazole

PEG-20(c) poly(ethylene glycol) containing 220 repeating units

Example 1

A series of coatings were prepared on a 7 mil (179 μm) clear poly(ethylene terephthalate) film support.

Coating A(c)

A silver bromide tabular grain emulsion having a mean ECD of 1.6 μm and a mean tabular grain thickness of 0.13 μm, tabular grains accounting for >90% of total grain projected area, was spectrally sensitized with anhydro-3,3'-bis(3-sulfopropyl)-5,5'-dichloro-9-ethyloxacarbocyanine hydroxide, sodium salt (SS-1) and optimally chemically sensitized with sodium thiosulfate, tetrachloroaurate, and potassium selenocyanate. Potassium iodide in the amount of 300 mg/Ag mole and 1 g/Ag mole of the sodium salt of 4-hydroxy-6-methyl-1,3,3a,7-tetraazaindene were added to the emulsion.

The emulsion was then coated at a silver coverage of 17.2 mg/dm$^2$ and 21.52 mg/dm$^2$ of gelatin. An overcoat of 7.2 mg/dm$^2$ gelatin containing bis(vinylsulfonylmethyl)ether in the amount of 2.0 weight percent, based on the total weight of gelatin in both layers was incorporated as a hardener.

Coatings B(c)–D(c)

Coatings similar to Coating A were prepared, except that one of the comparative 5-mercaptotetrazole addenda was added, as indicated in Table I.

Coatings E(ex)–J(ex)

Coatings similar to Coating A were prepared, except that one of the 5-mercaptotetrazole addenda satisfying formula (I) was added, as indicated in Table I.

Exposure and Processing

The coatings were each exposed through a step tablet to a 546 nm mercury emission line and processed using a conventional hydroquinone-Elon™ (p-N-methylaminophenol hemisulfate) developer.

TABLE I

| Ctg | PMT Cmpd | n | R | mg Ag M | Dmin | +0.2 Spd. | CP | b* |
|---|---|---|---|---|---|---|---|---|
| A(c) | None | None | None | None | 0.04 | 100 | 8.8 | 2.7 |
| B(c) | 17 | None | None | 100 | 0.04 | 78 | 9.9 | 2.6 |
| C(c) | 18 | None[3] | None[3] | 100 | 0.03 | 78 | 9.8 | 2.7 |
| D(c) | 19 | 3[3] | Me[3] | 200 | 0.04 | 66 | 9.9 | 2.1 |
| E(ex) | 1 | 0 | Me | 100 | 0.04 | 107 | 9.6 | 2.4 |
| F(ex) | 3 | 1 | Me | 200 | 0.04 | 126 | 9.9 | 2.7 |
| G(ex) | 6 | 2 | Me | 200 | 0.04 | 141 | 9.9 | 2.5 |
| H(ex) | 9 | 3 | Me | 200 | 0.04 | 138 | 9.8 | 2.4 |
| I(ex) | 12 | 4 | Me | 400 | 0.04 | 123 | 9.9 | 2.4 |
| J(ex) | 15 | 5 | Me | 200 | 0.04 | 141 | 9.8 | 2.5 |

[3]meta (3 ring position) substituent

From Table I it is apparent that the 5-mercaptotetrazole addenda failing to satisfy formula (I), B(c)–D(c), increase covering power (CP), but reduce imaging speed. Coatings B(c) and C(c) have no significant influence on image tone (b*). Coating D(c), which employs a 5-mercaptotetrazole that differs from formula (I) requirements only in placing the substituent $R(OCH_2CH_2)_nO$— substituent in the meta position on the phenyl ring, improves covering power and produces a significantly colder image tone, but suffers the disadvantage of producing the largest speed decrease observed. The formula (I) 5-mercaptotetrazole addenda of Coatings E(ex)–J(ex) produce significant increases is speed and covering power and simultaneously produce colder image tone.

Example 2

In this example coatings were prepared in which the R substituent of the formula (I) 5-mercaptotetrazole was varied.

A control coating without a 5-mercaptotetrazole addenda K(c) was prepared, exposed and processed similarly coating A(c) above. Invention coatings with varied formula (I) 5-mercaptotetrazole addenda were similarly prepared, exposed and processed. The addenda and the resulting performance are summarized in Table II.

TABLE II

| Ctg | PMT Cmpd | n | R | mg Ag M | Dmin | +0.2 Spd. | CP |
|---|---|---|---|---|---|---|---|
| K(c) | None | None | None | None | 0.04 | 100 | 8.7 |
| L(ex) | 2 | 1 | H | 200 | 0.05 | 115 | 9.9 |
| M(ex) | 3 | 1 | Me | 200 | 0.04 | 107 | 10.1 |
| N(ex) | 6 | 2 | Me | 200 | 0.05 | 132 | 10.0 |
| O(ex) | 7 | 2 | Et | 150 | 0.04 | 107 | 9.8 |

From Table II it is apparent that, when H or Et is substituted for Me as R in formula (I), the advantages imparted by the formula (I) 5-mercaptotetrazole are maintained. The coatings exhibited similar image tones.

Example 3

In this example a formula (I) 5-mercaptotetrazole was compared to the widely used addenda PMT-18(c), to a polyethylene glycol PEG-20(c) and to a combination of PMT-18(c) and PEG-20(c).

A control coating without a 5-mercaptotetrazole addenda P(c) was prepared, exposed and processed similarly as coating A(c) above. Except for addenda incorporation as indicated in Table III below, the remaining coatings were identically prepared, exposed and processed.

Table III

| Ctg | Cmpd(mg/Ag M) | Dmin | +0.2 Spd. | CP |
|---|---|---|---|---|
| P(c) | None | 0.04 | 100 | 8.5 |
| Q(ex) | PMT-6(200) | 0.05 | 141 | 9.9 |
| R(c) | PMT-18(100) | 0.04 | 81 | 9.8 |
| S(c) | PEG-20(6750) | 0.05 | 105 | 8.8 |
| T(c) | PMT-18(100) + PEG-20(6750) | 0.04 | 85 | 9.6 |

From Table III it is apparent that the formula (I) 5-mercaptotetrazole produced a large speed increase and large increase in covering power. The poly(ethylene glycol) alone produced a small speed increase and a small covering power increase. When the widely used 5-mercaptotetrazole was substituted for the formula (I) 5-mercaptotetrazole, a large speed loss resulted compared to having no 5-mercaptotetrazole addenda present and, when compared to the coating containing the formula (I) 5-mercaptotetrazole, the speed penalty was even more dramatic. Mixing PMT-18 and PEG-20 in a single coating did little to offset the speed loss attributable to PMT-18.

The invention has been described in detail with particular reference to preferred embodiments thereof, but it will be understood that variations and modifications can be effected within the spirit and scope of the invention.

What is claimed is:

1. A radiographic element comprised of a support and, coated on the support, an emulsion comprised of a hydrophilic colloid and radiation-sensitive silver halide grains containing greater than 50 mole percent bromide and less than 3 mole percent iodide, based on silver, greater than 50 percent of the total projected area of the silver halide grains being accounted for by tabular grains having a thickness of less than 0.3 $\mu$m, and, in an amount sufficient to increase covering power, a 5-mercaptotetrazole, WHEREIN the 5-mercaptotetrazole is a 1-(4-M-phenyl)-5-mercaptotetrazole in which M satisfies the formula:

$$R(OCH_2CH_2)_nO—$$

wherein n is an integer of from zero to 5;

when n is 1 to 5, R is hydrogen, methyl or ethyl; and, when n is zero, R is methyl.

2. A radiographic element according to claim 1 wherein R is methyl.

3. A radiographic element according to claim 1 wherein n is 1, 2 or 3.

4. A radiographic element according to claim 1 wherein the 1-(4-M-phenyl)-5-mercaptotetrazole is present in a concentration of at least 20 mg per silver mole.

5. A radiographic element according to claim 1 wherein the 1-(4-M-phenyl)-5-mercaptotetrazole is present in a concentration of up to 1 g per silver mole.

6. A radiographic element according to claim 1 wherein the 1-(4-M-phenyl)-5-mercaptotetrazole is present in a concentration of from 50 to 500 mg per silver mole.

7. A radiographic element according to claim 1 wherein the radiation-sensitive silver halide grains are contain greater than 70 mole percent bromide, based on silver.

8. A radiographic element according to claim 7 wherein the radiation-sensitive silver halide grains are silver bromide or silver iodobromide grains.

9. A radiographic element according to claim 1 wherein the support is a transparent film support having first and second major faces and the emulsion is coated on each of the first and second major faces of the support.

10. A radiographic element according to claim 1 wherein the 1-(4-M-phenyl)-5-mercaptotetrazole is chosen from the class consisting of 1-(4-MeOPh)-5-mercaptotetrazole;

1-(4-$HOCH_2CH_2OPh$)-5-mercaptotetrazole;

1-(4-$MeOCH_2CH_2OPh$)-5-mercaptotetrazole;

1-(4-$EtOCH_2CH_2OPh$)-5-mercaptotetrazole;

1-[4-$HO(CH_2CH_2O)_2Ph$]-5-mercaptotetrazole;

1-[4-$MeO(CH_2CH_2O)_2Ph$]-5-mercaptotetrazole;

1-[4-$EtO(CH_2CH_2O)_2Ph$]-5-mercaptotetrazole;

1-[4-$HO(CH_2CH_2O)_3Ph$]-5-mercaptotetrazole;

1-[4-$MeO(CH_2CH_2O)_3Ph$]-5-mercaptotetrazole;

1-[4-$EtO(CH_2CH_2O)_3Ph$]-5-mercaptotetrazole;

1-[4-HO($CH_2CH_2O$)$_4$Ph]-5-mercaptotetrazole;
1-[4-MeO($CH_2CH_2O$)$_4$Ph]-5-mercaptotetrazole;
1-[4-EtO($CH_2CH_2O$)$_4$Ph]-5-mercaptotetrazole;
1-[4-HO($CH_2CH_2O$)$_5$Ph]-5-mercaptotetrazole;
1-[4-MeO($CH_2CH_2O$)$_5$Ph]-5-mercaptotetrazole; and
1-[4-EtO($CH_2CH_2O$)$_5$Ph]-5-mercaptotetrazole, wherein Et is ethyl, Me is methyl, and Ph is phenyl.

* * * * *